US011609075B2

(12) United States Patent
Carter et al.

(10) Patent No.: US 11,609,075 B2
(45) **Date of Patent: *Mar. 21, 2023**

(54) ROTARY-DRIVE AMMUNITION RELOADING SYSTEMS WITH DISCONTINUOUS STROKE SPEED

(71) Applicant: DILLON PRECISION PRODUCTS, INC., Scottsdale, AZ (US)

(72) Inventors: Jason T. Carter, Manila, AR (US); Jason D. Pruett, Blytheville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/396,921

(22) Filed: Aug. 9, 2021

(65) Prior Publication Data

US 2021/0364262 A1 Nov. 25, 2021

Related U.S. Application Data

(63) Continuation of application No. 16/424,739, filed on May 29, 2019, now Pat. No. 11,085,746.

(60) Provisional application No. 62/678,101, filed on May 30, 2018.

(51) Int. Cl.

| | |
|---|---|
| ***F42B 33/00*** | (2006.01) |
| *F42B 7/02* | (2006.01) |
| *F42B 33/02* | (2006.01) |
| *F42B 33/12* | (2006.01) |

(52) U.S. Cl.

CPC ..... *F42B 33/001* (2013.01); *F42B 7/02* (2013.01); *F42B 33/004* (2013.01); *F42B 33/02* (2013.01); *F42B 33/12* (2013.01)

(58) Field of Classification Search

CPC ..... F42B 33/00; F42B 33/001; F42B 33/002; F42B 33/0278; F42B 33/004; F41A 15/14; F41A 3/66; F41A 3/12; F41A 19/10; F41A 17/64; F41G 11/003

USPC ..... 86/23–29, 45, 12, 10

See application file for complete search history.

(56) References Cited

U.S. PATENT DOCUMENTS

| | | | | |
|---|---|---|---|---|
| 2,024,513 | A | 12/1935 | Diescher | |
| 2,542,090 | A | 2/1951 | Lorenz | |
| 4,852,451 | A | 8/1989 | Rogers | |
| 7,743,692 | B2 | 6/2010 | Jackson | |
| 7,992,700 | B2 | 8/2011 | Thoonsen et al. | |
| 9,151,583 | B1 | 10/2015 | Stark et al. | |
| 9,664,488 | B2 | 5/2017 | Pruett et al. | |
| 9,879,961 | B2 * | 1/2018 | Pruett | F42B 33/001 |
| 9,982,982 | B2 | 5/2018 | Pruett et al. | |
| 10,619,984 | B2 * | 4/2020 | Pruett | F42B 33/004 |

(Continued)

OTHER PUBLICATIONS

"Computer controlled Dillon 1050." YouTube, uploaded by jmorrismetal, Mar. 23, 2014, https://www.youtube.com/watch?v=MrFhnDQeUU.

(Continued)

*Primary Examiner* — John Cooper

(74) *Attorney, Agent, or Firm* — Workman Nydegger; Logan Christenson; John Guynn

(57) ABSTRACT

An ammunition reloading system is configured to be operatively coupled with an ammunition reloading press to enable automated operation of the press. The reloading system includes a motor and a power transmission assembly that enables rotational power in a single direction from the motor to drive the ammunition reloading press. A controller is communicatively coupled to the motor and to one or more press position sensors to determine a position of the press within a press stroke cycle and increase or decrease the speed of the motor accordingly.

20 Claims, 5 Drawing Sheets

(56) References Cited

U.S. PATENT DOCUMENTS

| | | | | |
|---|---|---|---|---|
| 11,085,746 | B2 * | 8/2021 | Carter | F42B 33/0207 |
| 2006/0180011 | A1 | 8/2006 | Benn | |
| 2006/0180012 | A1 | 8/2006 | Benn | |
| 2009/0013859 | A1 * | 1/2009 | de Almeida | F42B 33/004 86/24 |
| 2013/0186261 | A1 | 7/2013 | May et al. | |
| 2014/0168661 | A1 | 6/2014 | Nygaard et al. | |
| 2016/0084624 | A1 | 3/2016 | Pruett et al. | |
| 2017/0108322 | A1 | 4/2017 | Pruett et al. | |
| 2017/0184384 | A1 * | 6/2017 | Kim | B07C 5/342 |
| 2018/0066926 | A1 | 3/2018 | Pruett et al. | |
| 2018/0252509 | A1 | 9/2018 | Pruett et al. | |
| 2018/0335286 | A1 | 11/2018 | Gatti | |
| 2019/0094000 | A1 | 3/2019 | Abel | |
| 2019/0257630 | A1 | 8/2019 | Stark et al. | |
| 2019/0368848 | A1 * | 12/2019 | Carter | F42B 33/0207 |
| 2020/0217634 | A1 | 7/2020 | Pruett et al. | |

OTHER PUBLICATIONS

"Dillon 1050 auto with PLC." YouTube, uploaded by atvraceryfz, Apr. 23, 2013, https://www.youtube.com/watch?v=N_On_1ha9w.

"Dillon 1050 auto with PLC." YouTube, uploaded by Maurizio Boccia, Aug. 19, 2014, https://www.youtube.com/watch?v=Ec_2BI6eep8.

"FFB Auto-Drive for the Dillon 1050—Index/Powder Drop Dwell Demo" YouTube, uploaded by Fast and Friendly Brass, May 19, 2018, https://www.youtube.com/watch?v=WP7v0F6YSkE&amp=&feature=youtub.

"Small primer pocket culler." YouTube, uploaded by jmorrismetal, Mar. 23, 2014, https://www.youtube.com/watch?v=c1V7vSEAgkZw.

Forcht Firearms and Machine, Apr. 1, 2013, http://www.forchtfirearms.com/images2/IMG_0929.JPG.

NPL, http://web.archive.org/web/20141114170232/http://reloaders.com/dillon- -super-1050-auto-drive; Nov. 14, 2014.

* cited by examiner

ROTARY-DRIVE AMMUNITION RELOADING SYSTEMS WITH DISCONTINUOUS STROKE SPEED

CROSS-REFERENCE TO RELATED APPLICATIONS

This application is a continuation of U.S. patent application Ser. No. 16/424,739, filed May 29, 2019, which claims priority to and the benefit of U.S. Provisional Patent Application Ser. No. 62/678,101, filed on May 30, 2018 and titled "Rotary-Drive Ammunition Reloading Systems with Discontinuous Stroke Speed," the entirety of which is incorporated herein by this reference.

BACKGROUND

The present disclosure relates generally to ammunition reloading systems configured to provide automated reloading of ammunition.

Ammunition reloading, also referred to as handloading, is the process of loading firearm cartridges or shotgun shells by assembling the individual components rather than purchasing pre-assembled or factory-loaded ammunition. Ammunition reloading can make use of entirely newly manufactured components or used components. For instance, typical reloading processes utilize previously fired cartridge cases. Ammunition reloading can be done for hobby, economic savings, increased control over accuracy/performance of ammunition, and to provide ammunition in periods of commercial ammunition shortages.

Typical ammunition components used in a reloading process include bullets, powder, cases, and primers. The reloading process typically follows the steps of resizing the case using one or more dies, seating a new primer in the used case, adding an amount of powder, seating a bullet in the case, and crimping the bullet in place if necessary.

Ammunition components are typically prepared and assembled using an ammunition reloading press. Available presses include single-stage presses, which perform one step on one case at a time, turret presses, which permit mounting of all the dies for one cartridge simultaneously with die switching performed by rotating the turret, and progressive presses, where each pull of the lever performs a single step on all cases in the press at once. Progressive presses can be fitted with all dies needed for a desired cartridge, along with a powder measure and primer feed, and can result in one finished round per pull during operation.

Recently, automation devices designed to integrate with ammunition reloading presses have been developed. These automation devices are typically configured to enable automatic operation of the reloading press without requiring the user to manually operate the press. Many of these devices function by operatively attaching to a main drive component of the reloading press and using a motor to power and actuate the drive component. Often, the motor power is transmitted to the drive component of the reloading press using a rotary drive that provides constant rotation in one direction. This in turn drives the press at a constant stroke speed through all positions of the stroke cycle.

Although such automation devices have the potential to increase reloading rates and round production, several limitations remain. In particular, where a conventional rotary drive reloading system is utilized, the constant rotation in a single direction at constant speed limits the ability to effectively control the stroke speed of the reloading press at different positions throughout the stroke cycle. There is thus a long felt and ongoing need for improved automated ammunition reloading press systems that provide more granular control of press stroke speed at different positions within the stroke.

BRIEF SUMMARY

In one embodiment, an ammunition reloading system is configured to be operatively coupled with an ammunition reloading press to enable automated operation of the press. The reloading system includes a motor and a power transmission assembly that enables rotational power in a single direction from the motor to drive the ammunition reloading press. A controller is communicatively coupled to the motor and to one or more press position sensors to determine a position of the press within a press stroke cycle and increase or decrease the speed of the motor accordingly.

In some embodiments, the ammunition reloading press includes an eccentric assembly such as a crank assembly and the power transmission assembly operatively couples to the eccentric assembly. The ammunition reloading system may further include one or more ammunition reloading component sensors communicatively coupled to the controller. The reloading component sensor(s) are configured to sense a state of a reloading component. For example, reloading component sensors may be configured to determine a level, size/dimension, presence, and/or status of bullets, powder, primers, cases, and/or other ammunition components. Such sensors may include optical sensors, mechanical switches, magnetic sensors (e.g., Hall effect sensors), and the like.

The press position sensors may be configured as an array of separate sensors each configured to determine a particular position of the press. The press position sensors may include optical sensors, inductive proximity sensors, mechanical switches, rotary encoders, or combinations thereof. Where rotary encoders are included, they may be configured as optical encoders, magnetic encoders, or mechanical contact encoders.

The controller may be configured to slow the motor when the determined press position corresponds to an indexing portion of the press stroke cycle and/or when the determined press position corresponds to a powder drop portion of the press stroke cycle. The controller may also be configured to stop the motor upon detecting a reloading error (e.g., via one or more of the integrated component or press position sensors described above). The sensors may be configured to sense one or more reloading errors including, for example: a mis-sized component (e.g., mis-sized case, cartridge, bullet, or primer); a malformed component; a missing component; a misaligned component; an improper component type (e.g., wrong primer type, wrong cartridge type, etc.); a component made from an improper material (e.g., determine if case is made of steel, brass, plastic, etc.); a case obstruction; and/or a jam. The motor may optionally include a braking system to assist in stopping the motor.

In some embodiments, the power transmission assembly includes a cam assembly. The cam assembly includes one or more cams configured in size and shape to provide differential press speed during press operation through the press stroke cycle. For example, the cam assembly may include a cam having a non-symmetric profile that operates to drive the ammunition reloading press with differential stroke speed.

BRIEF DESCRIPTION OF THE DRAWINGS

A more particular description will be rendered by the embodiments illustrated in the appended drawings. It is appreciated that these drawings depict only exemplary embodiments of the disclosure and are therefore not to be considered limiting of its scope. In the accompanying drawings.

DETAILED DESCRIPTION

Figure 1:
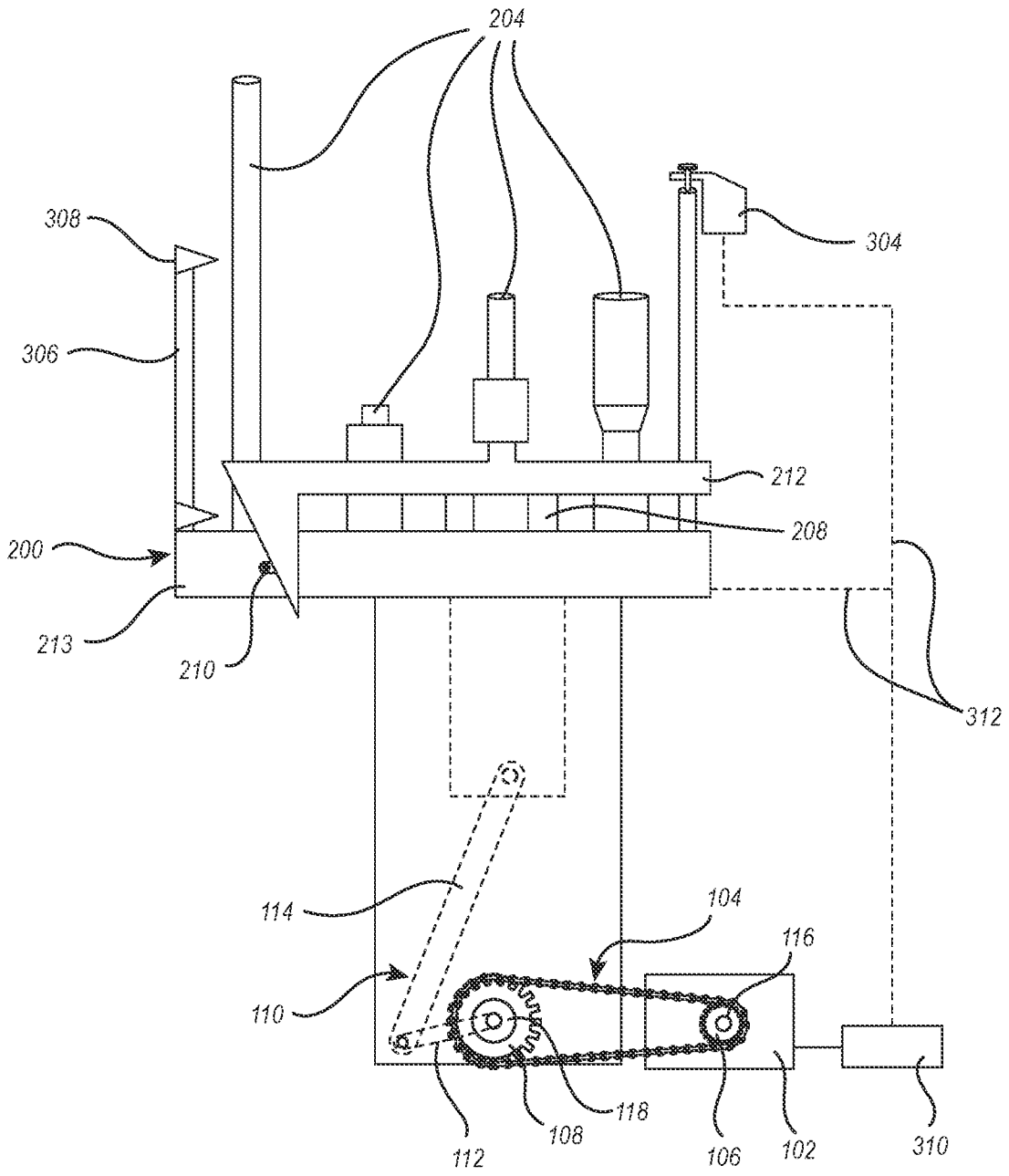
FIGS. 1 and 2 illustrate an exemplary embodiment of a reloading system configured for differential speed within the stroke cycle, with the reloading press shown in the up position and down position, respectively, and the reloading system including a motor that provides continual rotational movement in a single direction, a controller, and one or more press position sensors communicatively coupled to the controller.

FIG. 1 illustrates an embodiment of an automated ammunition reloading system. The reloading press 200 utilized in the reloading system may be any type of press usable in a process of ammunition reloading. The reloading press 200 may be a progressive press capable of producing at least one round of ammunition per pull and/or per press cycle. In other embodiments, a reloading press may be a single press or a turret press.

The reloading press 200 may be any press that is configured for one or more of the steps of positioning an ammunition case, reforming an ammunition case by pressing it within one or more dies, positioning a primer within an ammunition case, adding powder to an ammunition case, positioning or mounting a bullet onto a case, and sealing (e.g., crimping) a bullet in position on a case, for example. The reloading press may include one or more reloading press components 204 (e.g., bins, tubes, etc.) configured to store, sort, and/or align cases, primers, powder, bullets, finished rounds, and the like.

In some embodiments, the reloading press 200 is a progressive shotshell press. For example, the reloading press may be configured to perform one or more of the steps of depriming a shell, reshaping a shell, priming a shell, loading a shell with powder, pressing a wad into a shell, loading shot into a shell, and crimping a shell.

The illustrated reloading system also has an actuator assembly that includes a motor 102 communicatively coupled to a controller 310. The motor 102 is operatively coupled to a crank assembly 110 of the reloading press 200 by way of a power transmission assembly 104. The power transmission assembly 104 may include one or more sprocket, pulley, belt, roller chain, gearbox, other power transmission components known in the art, and combinations thereof. Although the illustrated power transmission assembly is shown with a belt/chain and pulley/sprocket configuration (with pulley/sprocket 106 and 108), other embodiments may directly couple the motor shaft to the corresponding drive shaft of the crank assembly 110.

The motor 102 is configured to transmit torque to the crank assembly 110 of the reloading press using a rotary drive that provides rotation in a single direction. The reloading system is configured to convert the rotary motion of the motor 102 into linear motion of the press column 208 and press head 212. Any mechanical conversion means known in the art may be utilized to provide this conversion. Typically, as illustrated, the reloading system will include a crank assembly 110 that may include, for example, a crank 112 and connecting rod 114, though other reloading systems may additionally or alternatively include rotary-to-linear transmission means such as an off-center bearing and/or other eccentric components (e.g., eccentric gear, wheel, disk, sheave, etc.).

Figure 2:
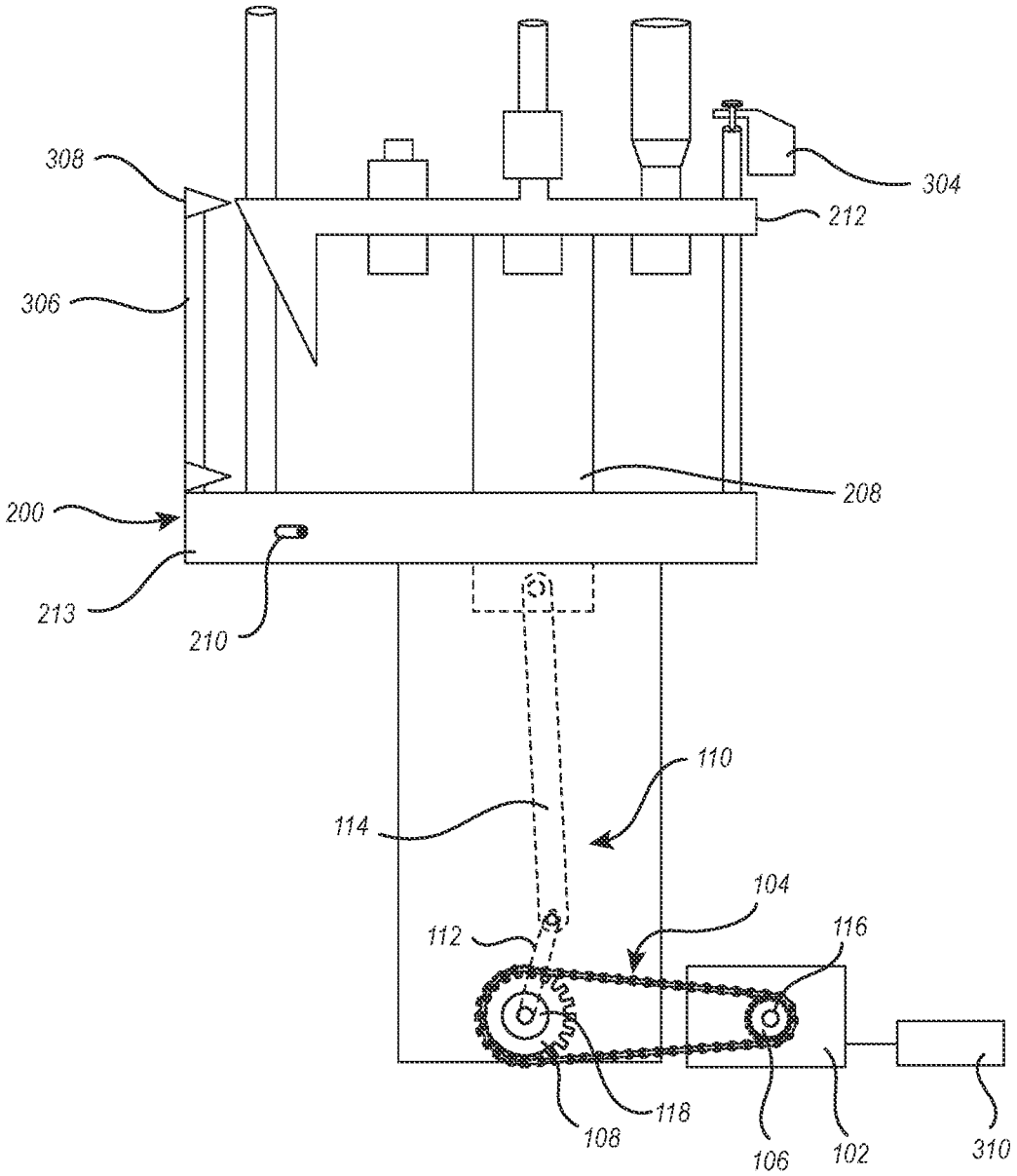

As rotary motion from the motor 102 is transferred to the crank assembly 110, the crank assembly 110 operates to move the press column 208 and as a result the reloading press moves between the closed position shown in FIG. 1 (where the press head 212 is near or against the shell plate 213) and the open position shown in FIG. 2 (where the press head 212 is positioned away from the shell plate 213).

In some embodiments, one or more sensors are coupled to the reloading press 200 or other components of the reloading system and are configured to be in communication with the controller 310. By way of example, the reloading system may include one or more reloading component sensors 304. The reloading component sensor 304 can be configured to detect the level and/or status of bullets, powder, primers, cases, and/or other ammunition components in one or more of the reloading components 204. For example, a reloading component sensor 304 can be coupled with a primer bin/tube and configured to detect the absence of primers and to send a corresponding signal to the controller 310. Other embodiments may include one or more sensors configured to detect levels of other round components (e.g., bullets, cases), detect reloading press and/or actuator assembly malfunctions (e.g., jams), and the like.

Sensors utilized with the reloading system may include magnetic sensors (including Hall effect sensors), mechanical sensors, optical sensors, or any other types of proximity sensors. For example, some embodiments include a primer sensor configured to detect the presence of a mis-sized and/or mischaracterized primer through coupling of the sensor with a pin that is sized and shaped to match appropriate primers during the reloading process. The sensor is triggered when the pin is displaced and/or when a predetermined force is applied to the pin. For example, the pin may be held in place within a die of the press, and positioned so that it is pressed away from the direction of die movement upon encountering an obstruction, upon encountering a primer that is sized too small for the pin to fit into, or upon encountering a type of primer that the pin has not been configured to fit into (e.g., a Berdan primer when the pin has been configured to fit into Boxer primers). In another example, a magnetic sensor is disposed on one or more case tube(s) of the reloading press 200. The magnetic sensor may be triggered upon coming into contact with a steel case and/or upon passage of a steel case through the case tube, for example.

The reloading system may also include one or more press position sensors configured to determine a position of the press within the stroke cycle and send a corresponding signal to the controller 310. Such sensors can beneficially enable the operation of the press at differential speeds within the stroke cycle. Often, a sliding pin 210 or other mechanical mechanism or other sensor described herein is actuated during each stoke cycle to cause corresponding actuation of the other reloading components of the press 200, such as actuation of a case downtube to move the next case into the press, rotation of a shell plate to move cases to their next respective positions within the press, and/or unloading of a finished case from the press.

Many reloading presses are designed to "index" when the press is at or near the top of the stroke. Indexing occurs when the shell plate has finished rotating to the next position in preparation for the down stroke of the press. Often, it is desirable to slow press movement near the end of shell plate 213 rotation and/or immediately after the shell plate 213 has finished rotating. This allows the cases to be appropriately moved without being jarred out of position and/or allows sufficient time for residual wobbling to stop before being acted on during the down stroke of the press.

As another example, many reloading presses are designed to deliver powder when the press is approaching or at the bottom of the stroke. It may be desirable to slow or even temporarily pause the press during the powder delivery phase of the stroke to ensure effective powder delivery and to ensure that there is sufficient time to deliver the desired amount of powder.

The indexing and powder drop phases of the stroke cycle represent some examples where differential speed during the stroke cycle may be desired. In other applications, it may be desirable for other portions of the stroke cycle to operate with differential speed. For example, in some applications it may be desirable to slow the press immediately after reaching the extent of the downstroke during the initial portion of the upstroke to ensure smooth disengagement of dies and other components from the cases. In some applications (e.g., depending on the type of ammunition being reloaded), it may be desirable to slow the press as the case plate 213 begins to rotate but not necessarily after rotation has started. In other applications, it may be desirable to slow the press as the case plate 213 nears the end of its rotation and/or immediately after rotation, but not necessarily during the initial phase of rotation.

The press position sensors described herein may be used to provide differential press speed within the stroke cycle, such as during those portions of the stroke cycle described by the foregoing and/or at other portions of the stroke cycle.

The illustrated reloading press 200 may include an attachment 306 including one or more press position sensors 308 configured to sense a position of the press within the stroke cycle. The press position sensor(s) 308 may include any type of sensor (including those described elsewhere herein) able to detect press position and/or movement to thereby provide press position information. Exemplary embodiments of press position sensors include optical sensors, inductive proximity sensors, and mechanical switches. Such a sensor may function, for example, by detecting the press head 212 as the press head 212 comes into contact with and/or moves past the sensor.

As shown, the sensors 308 may be aligned/positioned so as to be capable of detecting the press head 212 at different vertical positions during the stroke cycle. An array of such sensors, with each sensor located at a different position or directed to a different portion of the stroke cycle, can thereby detect the position of the press head 212 at multiple different positions. Press position sensors may additionally or alternatively be configured for detection of other components of the reloading system other than the press head 212. For example, one or more press position sensors may be associated with the press column 208, the crank assembly 210, or as explained in more detail below, the motor 102 and/or power transmission assembly 104.

As shown by the illustrated embodiment, the reloading system may include one or more rotary encoders 116, 118. The rotary encoders may be associated with the drive shaft of the motor 102 (as the case with rotary encoder 116) or with the connection to the drive component of the press 200 (as the case with rotary encoder 118). The rotary encoders 116, 118 are configured to determine a rotational position of the motor drive shaft and/or other rotating components associated with the power transmission assembly 104. By correlating the determined rotational position with the press position, the press position can be determined using the rotational position information generated by the rotary encoders 116, 118.

The rotary encoders 116, 118 may each independently be configured as an optical encoder (e.g., including a light source, code disc attached to the rotating shaft, and optical detectors), magnetic encoder (e.g., including a magnet mounted to the rotating shaft and one or more Hall-effect magnetoresistive, or inductive sensors, or other suitable magnetic sensors), or mechanical contact rotary encoder.

As illustrated (see FIG. 1), the motor 102, the one or more sensors 304, the one or more press position sensors 308, and the one or more rotary encoders 116, 118 may be connected to the controller 310 using a connection 312. The connection 312 may be a hard-wired connection (e.g., serial, USB, thunderbolt, etc.). Additionally, or alternatively, the motor 102 and/or one or more sensors 304, 308 may be connected to the controller 310 using a short-range wireless protocol (e.g., WiFi, Bluetooth, NFC, etc.) or through a network (e.g., a Local Area Network ("LAN"), a Wide Area Network ("WAN"), or the Internet).

The controller 310 is configured to receive press position information from the one or more press position sensors 308 and/or from the one or more rotary encoders 116, 118 and to use the position information to determine a position of the press. The controller 310 is also configured to receive differential speed settings (e.g., via user input through a suitable user interface). The controller 310 operates to correlate the determined press position with the desired speed settings, and then functions to control the motor 102 to reduce or increase press actuation speed accordingly.

The controller 310 can also function to pause the press during a stroke cycle for certain operations. For example, upon detection of a bad case or cartridge (e.g., from a signal received from a reloading component sensor 304), the controller 310 can pause the motor 102 to allow removal of the ineffective component.

In some circumstances, the controller 310 may also operate to automatically reverse rotation of the motor 102 to move the press "backwards" a short distance. For example, upon detection of a jam, the controller 310 may run the motor 102 in reverse a short distance to allow for clearance of the jam and/or additional inspection of the press. In such embodiments the motor 102 is preferably fitted with and/or operatively coupled to a braking system (e.g., resistive-based and/or mechanical-based). The braking system may be provided to ensure that the press can stop (and change direction if needed) within a sufficient time and distance.

Some embodiments may include both a set of one or more press position sensors 308 and a set of one or more rotatory encoders 116 and/or 118. In such embodiments, the press position sensors 308 may be utilized to calibrate the rotary encoders 116 and/or 118 so that rotary position is properly correlated to press position. After calibration, the stroke-to-stroke determination of press position can be handled by the rotary encoders 116 and/or 118. A rotary encoder will typically provide finer-grained positional information than a corresponding array of positional sensors 308, and may therefore be better suited for the real-time determination of press position. However, even in embodiments operated in this manner, occasional recalibration checks may be performed (automatically or manually) by comparing the rotary encoder information with the press position information received from the press position sensors 308 to ensure the rotary encoder(s) remain accurate.

Figure 3:
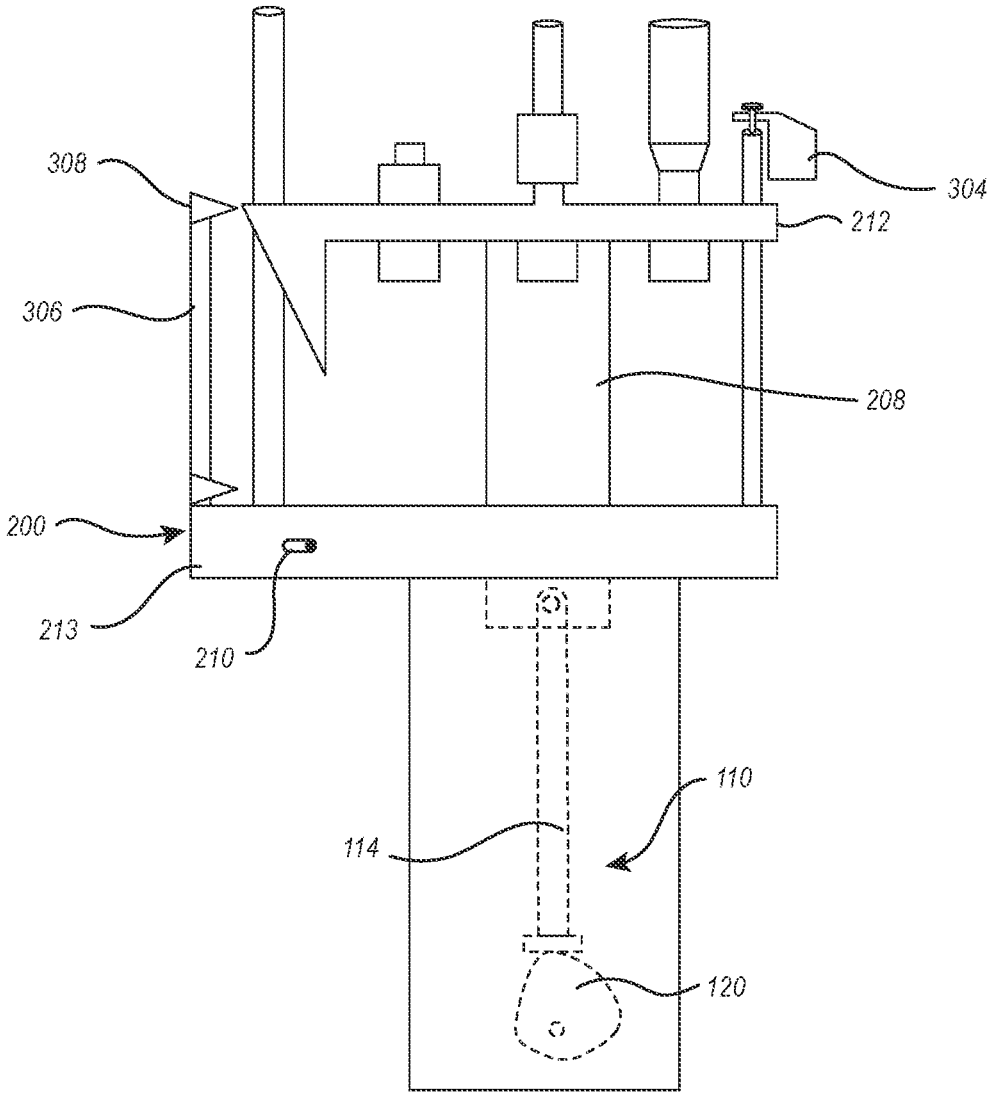
FIG. 3 illustrates the reloading system in a configuration that includes a cam assembly.

FIG. 3 illustrates another configuration for providing differential speed within the stroke cycle based on a cam assembly. Though the motor 102, controller, 310, and rotary encoders 116, 118 have been removed for visual clarity, it will be understood that the cam components described in relation to FIG. 3 may be utilized in conjunction with any of the components described in relation to FIGS. 1 and 2 above. As shown, a cam 120 may be positioned so as to be in operative relation to the connecting rod 114 (or alternatively directly to the press column 208). Rotation of the cam 120 therefore causes the press column 208 to move up and down through the press stroke.

Figure 4:
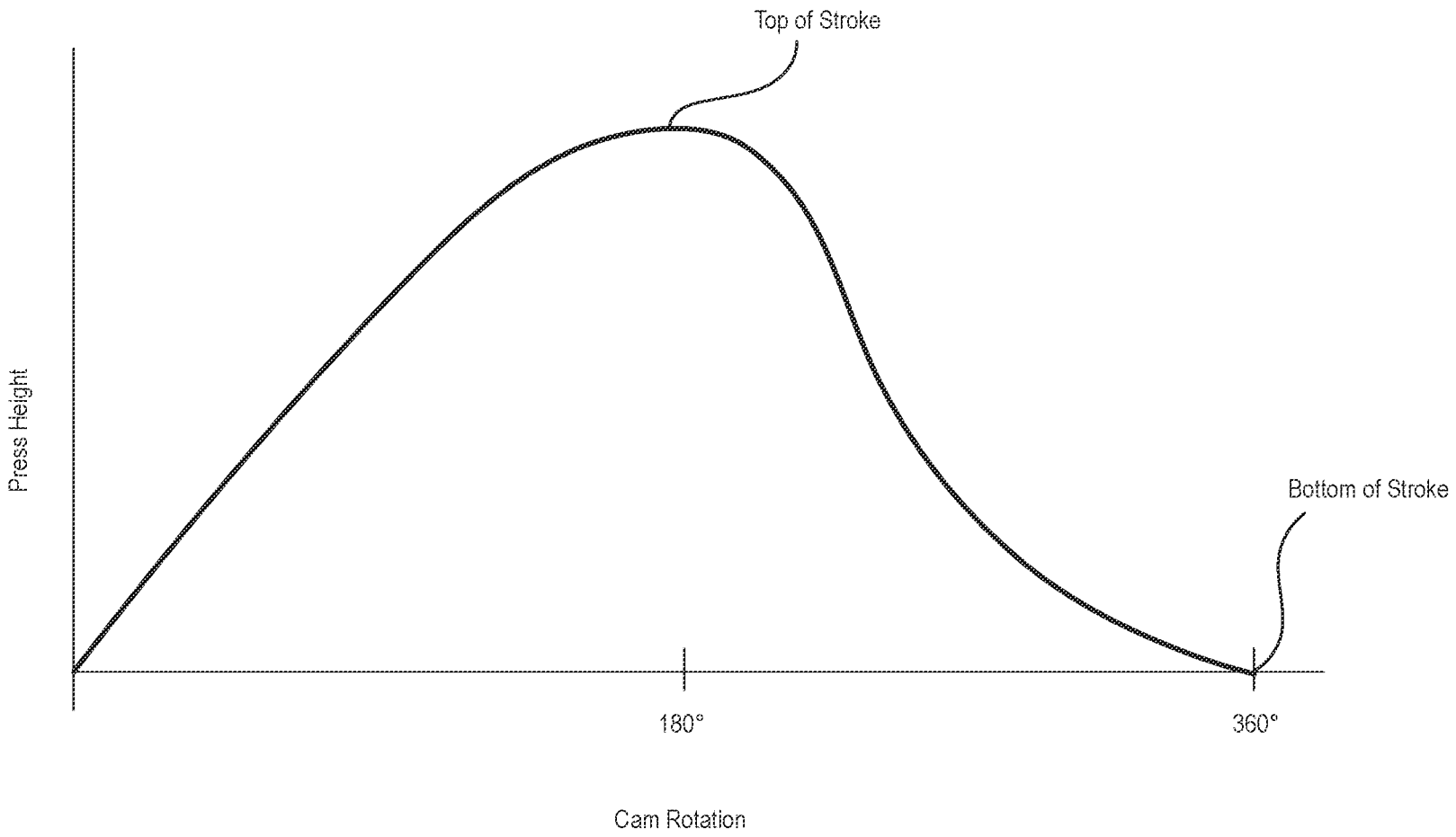
FIGS. 4 and 5 illustrates an exemplary displacement diagram and an exemplary cam, respectively, that may be utilized in the cam assembly of FIG. 3.

In some embodiments, the cam 120 is configured in shape and sized to provide differential speed through different portions of the press stroke. FIG. 4, for example, illustrates an exemplary displacement diagram that the cam 120 could be designed to provide. A displacement diagram is a known tool for characterizing cams based on the vertical displacement a "roller follower" would experience if positioned on top of the cam while the cam rotates. Here, the displacement of the roller follower has been replaced with the resulting "Press Height" based on the rotational position of the cam.

As shown, the cam 120 may be shaped so that during the initial phase of rotation, the press raises relatively quickly before slowing somewhat prior to reaching the top of the stroke. After reaching the top of the stroke, the press begins to move downward relatively slowly before speeding up to a faster descent. Before reaching the bottom of the stroke, the descent speed then slows again. The slowing near the top of the stroke may correspond to an indexing phase of the press, and the slowing near the bottom of the stoke may correspond to a powder drop phase of the press.

Figure 5:
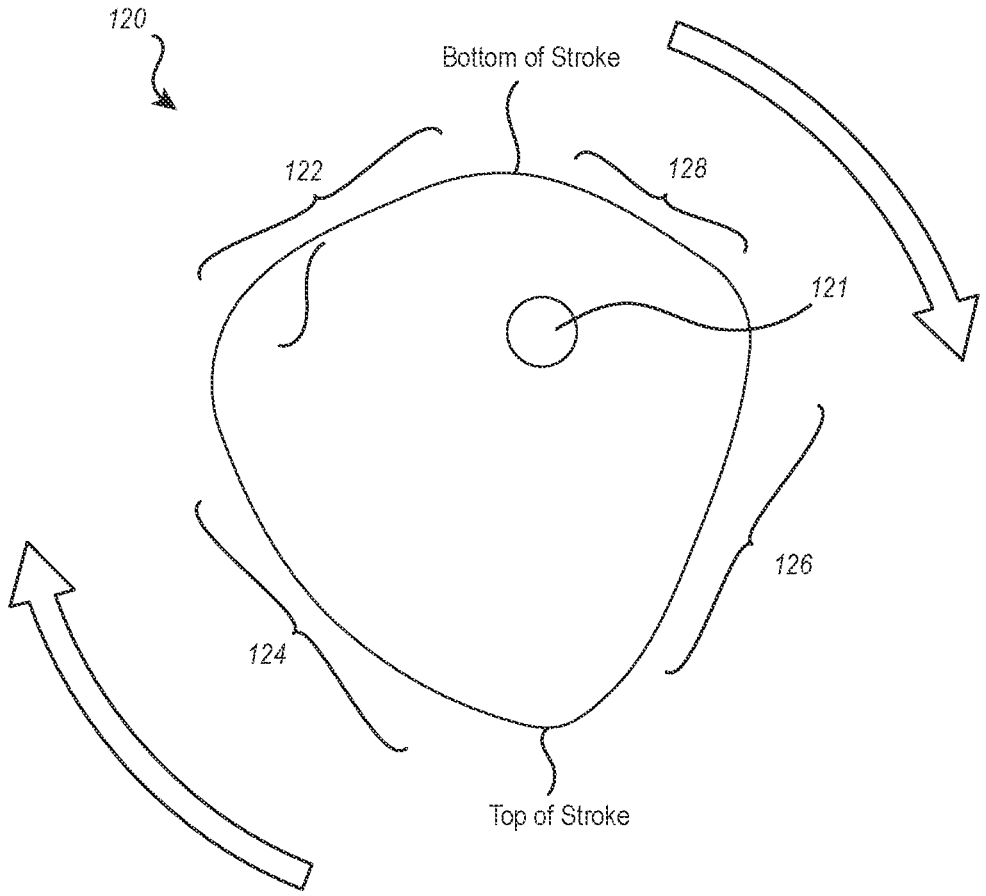

FIG. 5 provides one example of a cam 120 that could provide a displacement diagram similar to that shown in FIG. 4. Given cam center 121, and considering clockwise rotation of the cam 120, the press would first move according to cam region 122, then region 124, then region 126, then region 128 before beginning again at 122. Cam region 122 provides a relatively rapid increase in distance from cam center 121, corresponding to relatively fast upward movement of the press. Cam region 124 then transitions to a less abrupt increase in distance from cam center 121, corresponding to relatively slower movement of the press as it reaches the top of the stroke. Cam region 126 then includes a relatively abrupt decrease in distance from the cam center 121, corresponding to a relatively fast speed as the press drops during the initial part of the downstroke. Cam region 128 then includes a relatively less abrupt decrease in distance from the cam center 121, corresponding to a slowed press descent near the bottom of the stroke.

The cam structure shown in FIG. 5 and the displacement diagram shown in FIG. 4 are exemplary only, and it will be understood that several other cam designs may be utilized to provide differential speed during the press stroke cycle. Unlike standard cams, which typically have a relatively simple and symmetric shape, cams utilized with the reloading press systems described herein are preferably non-symmetric with respect to the cam center. That is, the cam 120 preferably cannot be bisected through the cam center 121 to provide mirror-image sections on either side of the bisecting line.

In embodiments that utilize a cam assembly, the cam assembly can provide a mechanical "baseline" of differential press speed. This baseline can be modified further using the controller 310 and associated sensors and/or rotary encoders as described above. For example, while the cam assembly may provide a baseline level of speed differentiation during certain portions of the stroke, the controller 310 can be utilized to further adjust press speed by controlling motor speed at certain detected press positions.

For instance, a user may wish to augment the baseline speed differentiation already provided by the cam assembly by increasing motor speed at the "fast" portions of the stoke and/or decreasing motor speed at the "slow" portions of the stroke. Alternatively, for some applications a user may wish to utilized the controller 310 to compensate for the baseline speed differentiation provided by the cam assembly, such as by decreasing motor speed at the "fast" portions of the stroke and/or increasing motor speed at the "slow" portions of the stroke. Thus, a cam assembly can be utilized to provide a typical or most commonly desired speed profile, while the controller 310 and associated position sensor componentry can be utilized to customize from the baseline profile as needed.

The invention claimed is:

1. An ammunition reloading system configured for attachment to an ammunition reloading press to automate the ammunition reloading press, the ammunition reloading system comprising:

a motor;

a power transmission assembly coupled to the motor and configured to couple to a drive component of an ammunition reloading press, the power transmission assembly being configured to enable rotational power in a single direction from the motor to drive the ammunition reloading press;

one or more press position sensors configured to determine a position of the ammunition reloading press within a press stroke cycle;

a controller communicatively coupled to the motor and to the one or more press position sensors, the controller being configured to:

receive press position information from the one or more press position sensors, determine a position of the press within the press stroke cycle, in response to determining that the position of the press within the press stroke cycle corresponds to being at or near a top of the stroke, decrease a speed of the motor to a first speed, in response to determining that the position of the press within the press stroke cycle corresponds to being at or near a bottom of the stroke, decrease the speed of the motor to a second speed, and in response to determining that the position of the press within the press stroke cycle corresponds to a beginning of rotation of a case plate of the ammunition reloading press, decrease the speed of the motor to a third speed.

2. The ammunition reloading system of claim 1, further comprising an ammunition reloading press operatively coupled to the ammunition reloading device.

3. The ammunition reloading system of claim 1, wherein the power transmission assembly includes a direct connection of a drive shaft of the motor to the drive component of the ammunition reloading press such that the drive shaft is aligned with the drive component.

4. The ammunition reloading system of claim 1, wherein the power transmission assembly includes one or more pulleys and/or sprockets and one or more chains and/or belts, and optionally one or more gearboxes.

5. The ammunition reloading system of claim 1, wherein the ammunition reloading press includes an eccentric assembly such as a crank assembly and the power transmission assembly operatively couples to the eccentric assembly.

6. The ammunition reloading system of claim 1, further comprising one or more ammunition reloading component sensors communicatively coupled to the controller.

7. The ammunition reloading system of claim 1, wherein the one or more press position sensors are provided as an array of press position sensors each configured to determine a particular position of the press.

8. The ammunition reloading system of claim 1, wherein the one or more press position sensors includes one or more optical sensors, inductive proximity sensors, mechanical switches, or combinations thereof.

9. The ammunition reloading system of claim 1, wherein the one or more press position sensors includes one or more rotary encoders.

10. The ammunition reloading system of claim 9, wherein the one or more rotary encoders are configured as optical encoders, magnetic encoders, or mechanical contact encoders.

11. The ammunition reloading system of claim 1, wherein the position of the press within the press stroke cycle being at or near the top of the stroke corresponds to an indexing portion of the press stroke cycle.

12. The ammunition reloading system of claim 1, wherein the position of the press within the press stroke cycle being at or near the bottom of the stroke corresponds to a powder drop portion of the press stroke cycle.

13. The ammunition reloading system of claim 1, wherein the controller is further configured to stop the motor upon receiving a reloading error from one or more component sensors, the reloading error including detection of a missized component, a malformed component, a missing component, a misaligned component, an improper component type, a component made from an improper material, a case obstruction, and/or a jam, and wherein the motor optionally includes a braking system to assist in stopping the motor.

14. The ammunition reloading system of claim 13, wherein the controller is further configured to automatically reverse direction of the motor a distance upon detecting the bad case or cartridge, missing component, misaligned component, and/or potential jam, and wherein the motor optionally includes a braking system to assist in reversing the direction of the motor.

15. The ammunition reloading system of claim 1, wherein the power transmission assembly further comprises a cam assembly, and wherein the cam assembly includes one or more cams configured in size and shape to provide differential press speed during press operation through the press stroke cycle.

16. The ammunition reloading system of claim 15, wherein the cam assembly includes a cam having a non-symmetric profile.

17. The ammunition reloading system of claim 1, wherein one or more of the first speed, the second speed, and the third speed are equal.

18. An ammunition reloading system configured for attachment to an ammunition reloading press to automate the ammunition reloading press, the ammunition reloading system comprising:

a motor;

a power transmission assembly coupled to the motor and configured to couple to a drive component of an ammunition reloading press, the power transmission assembly being configured to enable rotational power in a single direction from the motor to drive the ammunition reloading press, the power transmission assembly including a cam assembly that includes one or more cams comprising a cam shape that includes at least two different regions associated with different respective ammunition reloading press linear velocities such that a full rotation of the one or more cams at a substantially constant rotational velocity causes linear movement of the ammunition reloading press according to each of the different respective ammunition reloading press linear velocities.

19. The ammunition reloading system of claim 18, further comprising an ammunition reloading press operatively coupled to the ammunition reloading device.

20. The ammunition reloading system of claim 18, wherein the power transmission assembly includes a direct connection of a drive shaft of the motor to the drive component of the ammunition reloading press such that the drive shaft is aligned with the drive component.

* * * * *